US006550825B2

(12) United States Patent
Ostrowski et al.

(10) Patent No.: US 6,550,825 B2
(45) Date of Patent: Apr. 22, 2003

(54) CINCHING DOOR LATCH WITH PLANETARY RELEASE MECHANISM

(75) Inventors: Artur Jerzy Ostrowski, Rochester Hills, MI (US); Joseph Michael Johnson, Huntington Woods, MI (US); Hoi Wah Chow, Troy, MI (US); Gregory A Kasinec, Oxford, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/874,921

(22) Filed: Jun. 5, 2001

(65) Prior Publication Data

US 2002/0000725 A1 Jan. 3, 2002

Related U.S. Application Data

(60) Provisional application No. 60/209,615, filed on Jun. 6, 2000.

(51) Int. Cl.[7] ..... E05C 03/06

(52) U.S. Cl. ..... 292/199; 292/201; 292/216

(58) Field of Search ..... 292/201, 216, 292/DIG. 23, 199; 49/279, 280

(56) References Cited

U.S. PATENT DOCUMENTS 5,474,338 A * 12/1995 Buscher ..... 292/199
5,639,130 A * 6/1997 Rogers et al. ..... 292/199
5,918,917 A * 7/1999 Elton et al. ..... 292/201
6,053,542 A * 4/2000 Ostrowski et al. ..... 292/201
6,125,583 A * 10/2000 Murray et al. ..... 49/291
6,125,586 A * 10/2000 Buscher ..... 49/352
6,314,773 B1 * 11/2001 Miller et al. ..... 292/142
6,341,448 B1 * 1/2002 Murray et al. ..... 49/280

* cited by examiner

*Primary Examiner*—Anthony Knight
*Assistant Examiner*—Mark Williams
(74) *Attorney, Agent, or Firm*—Kathryn A. Marra

(57) ABSTRACT

A cinching door latch has a fork bolt that pivots between a primary latched position and an unlatched position. A detent lever pivots between a an engaged position and a disengaged position holds the fork bolt in the primary latched position when in the engaged position and releases the fork bolt for movement to the unlatched position when in the disengaged position. A transfer lever pivots between a lock position and an unlock position is operatively connected to the detent lever for pivoting the detent lever to the disengaged position. A cinching mechanism assures that the fork bolt is pivoted to the primary latched position when the door is closed. The cinching mechanism has a cinching gear drivingly connected to the fork bolt, a power driven planetary gear set for driving the cinching gear, and a one-way device. The one-way device limits rotation of an element of the planetary gear set to one direction so that the fork bolt can be pivoted to the primary latched position without back driving the input to the planetary gear set in the event of power failure. A release mechanism disables the one-way device so that the fork bolt can move to an unlatched position without back driving the input to the planetary gear set.

10 Claims, 4 Drawing Sheets

CINCHING DOOR LATCH WITH PLANETARY RELEASE MECHANISM

RELATED APPLICATION

This patent application claims priority of U.S. Provisional Patent Application No. 60/209,615 filed Jun. 6, 2000.

FIELD OF THE INVENTION

This invention relates to door latches and more particularly to a cinching door latch for an automotive vehicle.

BACKGROUND OF THE INVENTION

An automotive door latch typically includes a fork bolt that is pivoted between an unlatched position and a primary latched position when the door is closed to latch the door in the closed position. The fork bolt is typically held in the primary latched position by a detent lever that pivots between an engaged position and a disengaged position. The detent lever holds the fork bolt in the primary latched position when in the engaged position and releases the fork bolt when in the disengaged position so that the door can be opened.

The fork bolt is pivoted to the primary latched position by a striker attached to the door jamb when the door is closed. In some instances, the door may not be closed with enough force to pivot the fork bolt all the way to the primary latched position where the fork bolt is engaged and held in the primary latched position by the detent engaging a primary latch shoulder of the fork bolt. Consequently the fork bolt includes a secondary latch shoulder that is easily engaged by the detent lever to avoid any possibility of the door opening when the vehicle is moving down the road. This is known as the secondary latch position. It is also known to provide a cinching door latch in which the fork bolt is driven to the primary latched position once the door has been closed with enough force so that the fork bolt is pivoted to the secondary latch position where the secondary latch shoulder of the fork bolt is engaged by the detent lever. Alternatively, the cinching mechanism can be actuated when the fork bolt is pivoted toward the primary latched position a predetermined distance even if the secondary latch shoulder is not engaged.

SUMMARY OF THE INVENTION

This invention provides an automotive door latch that has a cinching mechanism for assuring that the fork bolt is in a primary latched position when the door is closed. The cinching mechanism of the invention has a cinching gear drivingly connected to the fork bolt, a power driven planetary gear set for driving the cinching gear, and a one-way device for limiting rotation of an element of the planetary gear set to one direction so that the fork bolt can be latched in the primary latched position manually without the necessity of back driving the input to the planetary gear set in the event of power failure. The cinching mechanism also preferably includes a release mechanism to disable the one-way device so that the fork bolt can move to an unlatched position without back driving the input to the planetary gear set.

DETAILED DESCRIPTION OF PREFERRED EMBODIMENT

Figure 1:
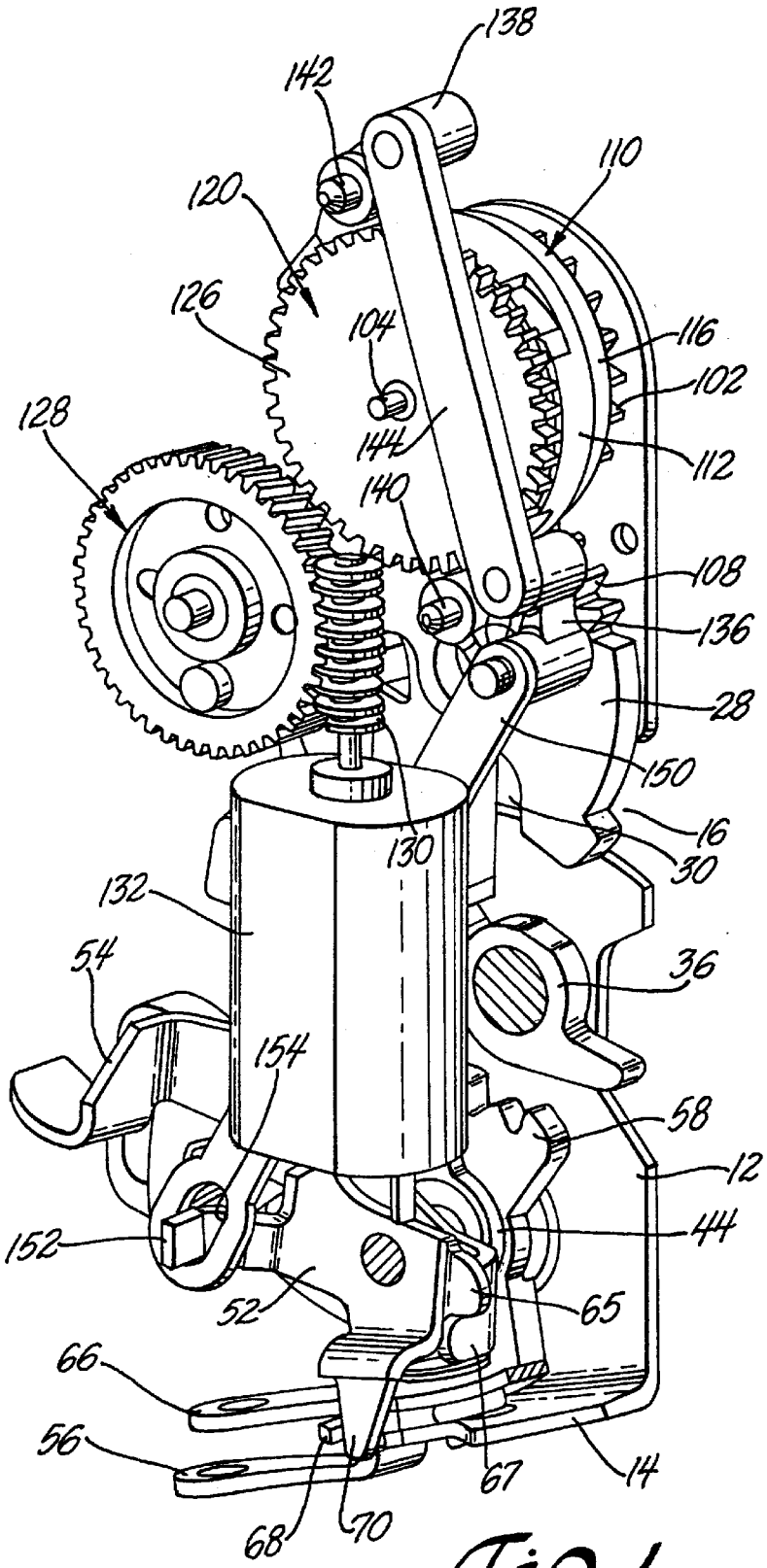
FIG. 1 is a perspective view of a cinching door latch of the invention with housing covers and other parts removed to show internal detail.
Figure 4:
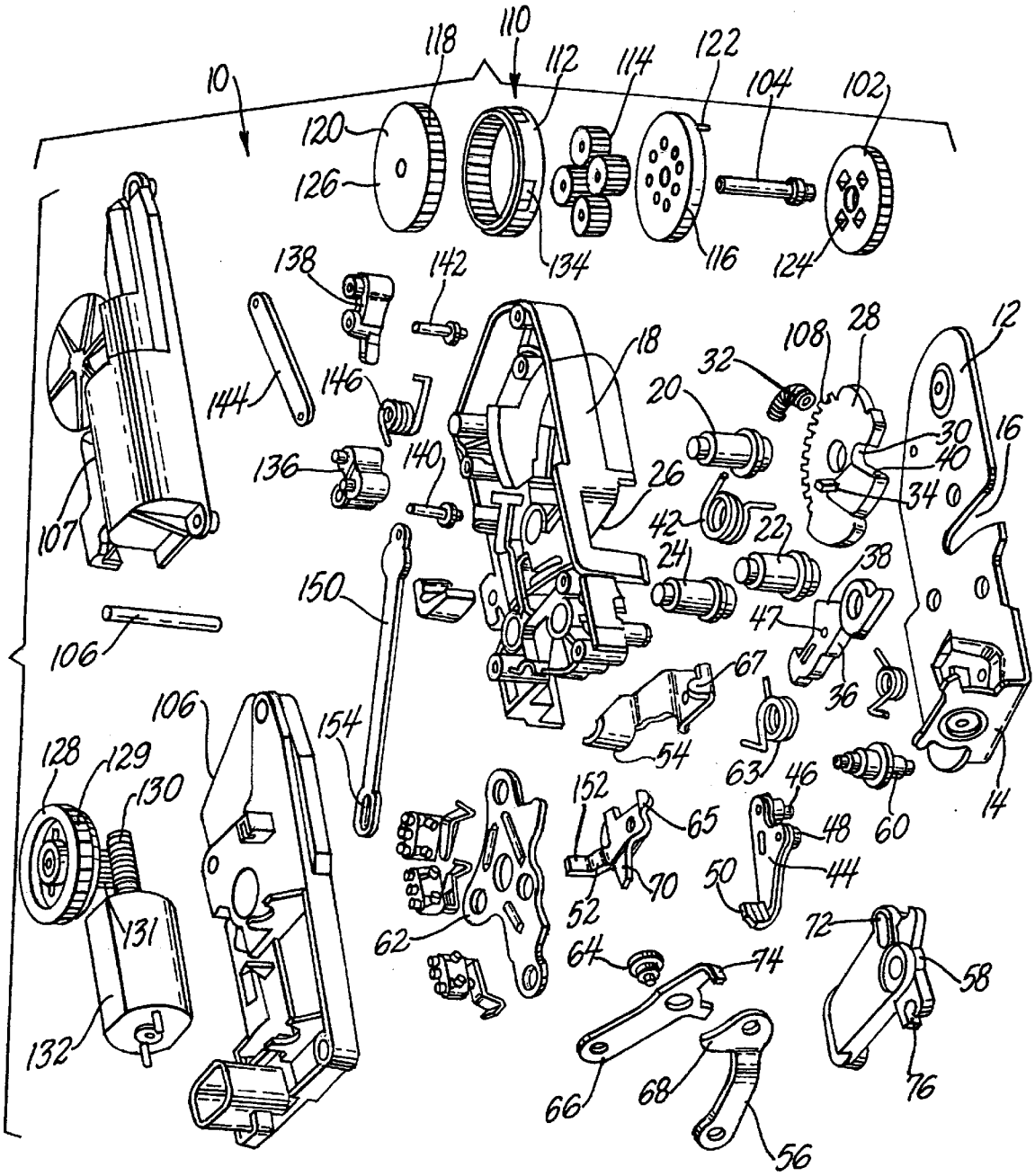
FIG. 4 is an exploded perspective view of the door latch that is shown in FIGS. 1, 2 and 3.

Referring now to FIGS. 1 and 4 the cinching door latch 10 of the invention comprises a frame 12 that has a flange 14 at one end and a fish-mouth slot 16 for receiving a conventional striker (not shown). The frame 12 is attached to a latch housing 18 by three bushings 20, 22 and 24. Housing 18 has a fish-mouth slot 26 that aligns with fish-mouth slot 16 of frame 12 for receiving a striker (not shown) when the door is closed. Strikers for door latches and their operation are well known and need not be described.

Bushing 20 serves as a pivot pin for a conventional fork bolt 28 which pivots in latch housing 18 between a primary latched position and an unlatched position shown in FIG. 4 where the striker receiving slot 30 is poised to receive the striker (not shown) that is pushed into the aligned fish-mouth slots 16 and 26 when the vehicle door is closed. The entering striker rotates fork bolt 28 to the latched position (shown in FIG. 3) trapping the striker (not shown) in the door latch 10. The fork bolt 28 is urged toward the unlatched position (shown in FIG. 3) by a spring 32 (FIG. 4) that has one end engaging a wall of the housing 18 and the opposite end engaging pin 34 of the fork bolt.

Figure 2:
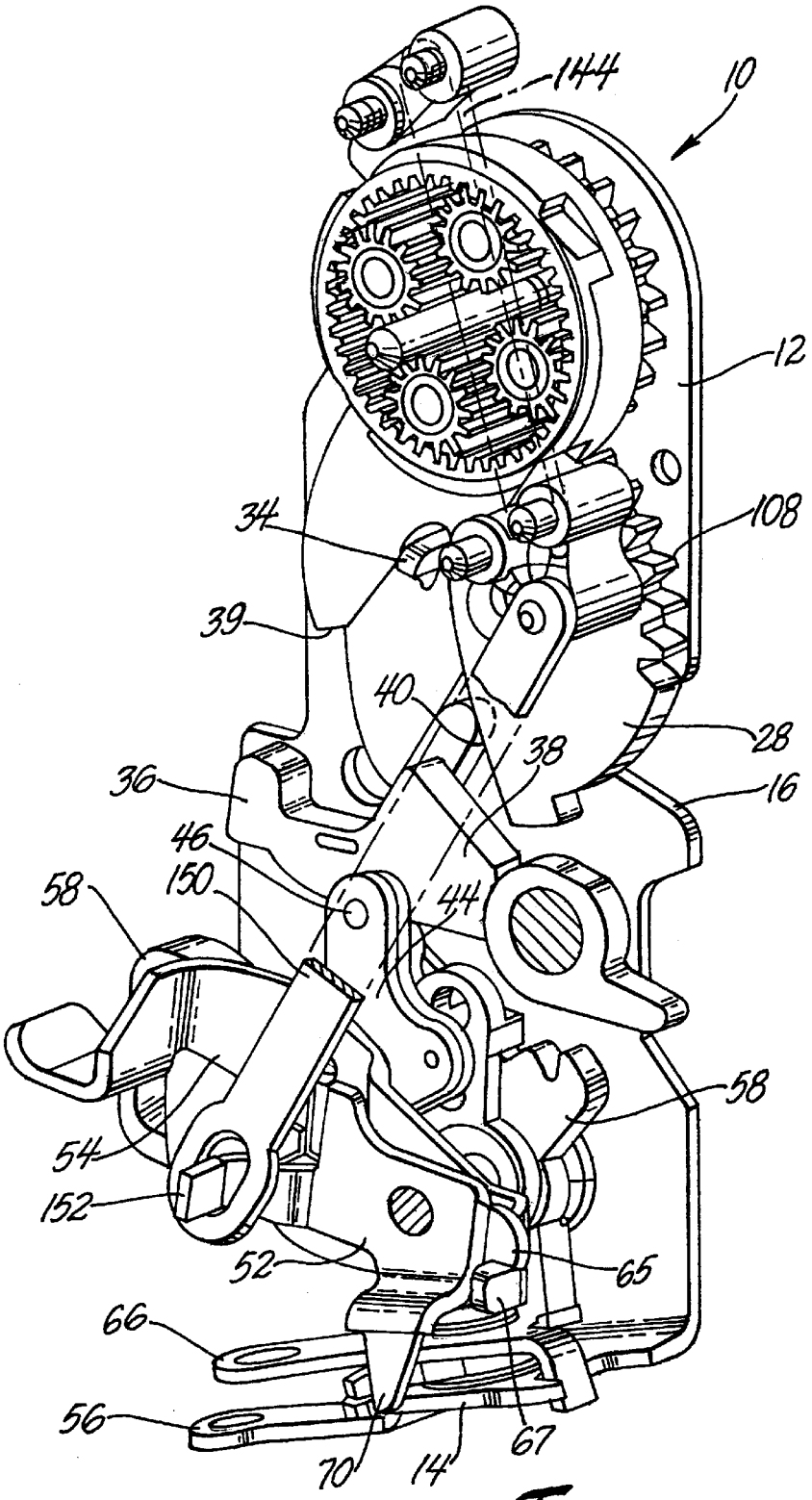
FIG. 2 is a perspective view of the cinching door latch of FIG. 1 with more parts removed to show internal details with the fork bolt in a primary latched position.

The fork bolt 28 is held in the primary latched position by a detent lever 36 that has a catch 38 that engages a primary latch shoulder 40 of fork bolt 28 when detent lever 36 is in the engaged position shown in FIG. 2. Detent lever 36 is pivotally mounted on bushing 22 so that detent lever rotates between the engaged position and a disengaged position shown in FIG. 3 where catch 38 is located outwardly of primary latch shoulder 40. Detent lever 36 is biased toward the engaged position by a detent spring 42 (FIG. 4) that is mounted loosely on bushing 22 above detent lever 36. Forkbolt 28 also has a secondary latch shoulder 39 that is easily engaged by detent lever 36 if the fork bolt 28 is not rotated with sufficient force to engage primary latch shoulder 40. This secondary latch position (not shown) is conventional and avoids any possibility of the vehicle door opening when the vehicle is moving down the road.

Detent lever 36 is operated by a release mechanism comprising an intermittent lever 44 that is pivotally attached to detent lever 36 by an integral pivot pin 46 that fits in a hole 47 of the detent lever 36. Intermittent lever 44 also has a second integral pivot pin 48 that is used to position the intermittent lever 44 in an unlocked position or a locked position as explained below in connection with the locking mechanism. Intermittent lever 44 also includes a tab 50 that is part of the release mechanism.

The release mechanism further comprises a transfer lever 52, an inside unlatching lever 54, and an outside unlatching lever 56. Digressing for a moment, the locking mechanism includes a locking lever 58 that is pivotally mounted on the lower portion of a stud 60 that is secured at opposite ends in aligned holes in frame 12 and back plate 62 outwardly of housing 18. Back plate 62 is held against the back of latch housing 18 by the peened ends of bushings 20, 22 and 24.

Returning to the release mechanism, the inside unlatching lever 54 is pivotally mounted on the upper part of stud 60 and spaced from the locking lever 58 by an integral flange of the stud. Transfer lever 52 is pivotally mounted on the upper part of stud 60 next to the inside unlatching lever 54. Transfer lever 52 moves between a latch position shown in FIG. 2 and an unlatch position shown in FIG. 3. A transfer lever spring 63 (FIG. 4) biases transfer lever 52 clockwise toward the latch position. Transfer lever 52 has an ear 65 at one end that engages a perpendicular tab 67 of inside unlatching lever 54 so that inside unlatching lever 54 is also biased to a latch position as best shown in FIG. 2. Outside unlatching lever 56 is pivotally mounted on frame flange 14 by a double shoulder rivet 64 which also pivotally mounts an outside lock lever 66 on flange 14 next to the outside unlatching lever 56.

The release mechanism operates as follows. Assuming that the intermittent lever 44 is in the unlocked position, the fork bolt 28 is released by rotating the transfer lever 52 counterclockwise against the bias of spring 63 from the latch position shown in FIG. 2 to an unlatch position shown in FIG. 3. As transfer lever 52 rotates counterclockwise, the transfer lever 52 engages tab 50 of intermittent lever 44 (FIG. 4) and pulls intermittent lever 44 down from the latch position shown in FIG. 2 to the unlatch position shown in FIG. 3. This rotates detent lever 36 counterclockwise to the disengaged position releasing fork bolt 28 for movement to the unlatched position when the door is opened. Transfer lever 52 can be rotated counterclockwise either by the inside unlatching lever 54 or the outside unlatching lever 56. Rotating the inside unlatching lever 54 counterclockwise rotates the transfer lever 52 counterclockwise via tab 67 and ear 65. Inside unlatching lever 54 can be rotated by a conventional inside handle and a suitable linkage connecting the inside unlatching lever 54 to the handle and/or by a power mechanism (not shown). Rotating the outside unlatching lever 56 clockwise rotates the transfer lever 52 counterclockwise by the tab 68 of outside unlatching lever 56 engaging a second ear 70 of transfer lever 52. Outside unlatching lever 56 is conventionally rotated by an outside handle that is connected to the outside unlatching lever 56 by a suitable linkage.

Figure 3:
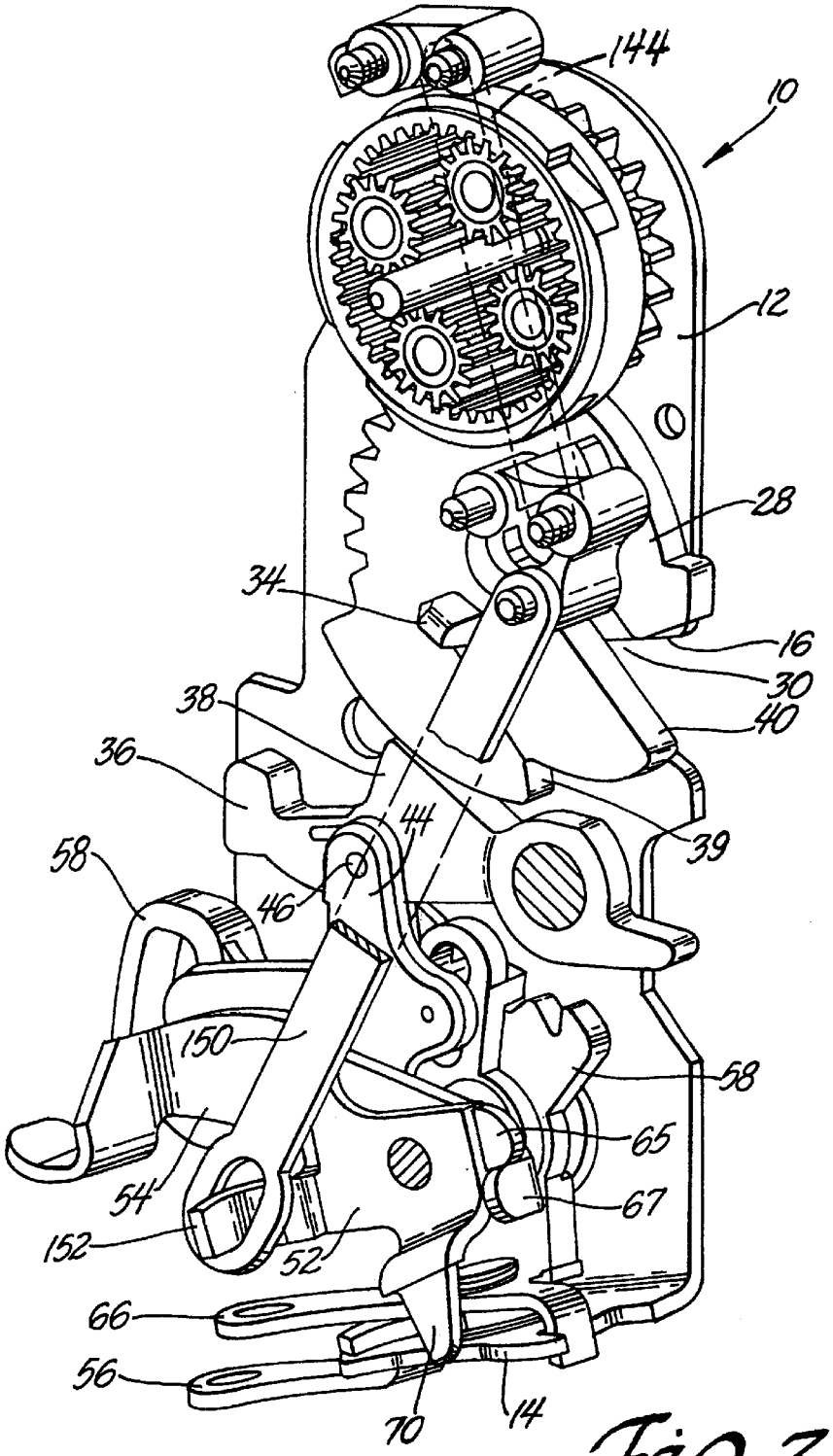
FIG. 3 is a perspective view of the cinching door latch with more parts removed as in FIG. 2 to show internal detail with the fork bolt in an unlatched position and the release mechanism actuated.

Door latch 10 also includes a lock mechanism that comprises the locking lever 58 that is pivotally mounted on bushing 22 for movement between a locked position and an unlocked position that is shown in FIGS. 2, 3 and 4. Locking lever 58 has a slot 72 that receives the second pivot pin 48 of intermittent lever 44 and locates the intermittent lever 44 in either an unlocked position shown in FIGS. 2, 3 and 4 or a locked position (not shown). When locking lever 58 is in the unlocked position shown in FIGS. 2, 3 and 4 the locking lever 58 locates the intermittent lever 44 in the unlocked position through the engagement of slot 72 and second pivot pin 48. When locking lever 58 is moved counter-clockwise to the locked position, slot 72 acting on second pivot pin 48 pivots intermittent lever 44 clockwise about pivot pin 46 to the locked position where transfer lever 52 bypasses tab 50 of the intermittent lever 44 when the transfer lever 52 is rotated to the unlatch position. Locking lever 58 is moved by rotating outside lock lever 66 which is coupled to locking lever 58 by a tab 74 engaging a socket 76 of locking lever 58. Locking lever 58 also has a perpendicular tab 78 that cooperates with slot 80 in flange 14 to limit movement of locking lever 58. Door latch 10 as thus far described is more or less conventional and known from the U.S. Pat. No. 5,277,461 issued to Thomas A. Dzurko et al on Jan. 11, 1994.

Door latch 10 also includes a cinch mechanism 100 that draws the striker into the door latch 10 and latches the striker securely in the door latch 10 when the vehicle door equipped with the door latch 10 is closed. Cinch mechanism 100 comprises a cinch gear 102 that is journalled on a stationery shaft 104 that is mounted a chamber formed by housing 14 and a lower latch cover 106 (FIG. 4) that is attached to housing 18. Cinch gear 102 meshes with teeth 108 that are formed in the periphery of fork bolt 28. A planetary gear set 110 is journalled on shaft 104 above cinch gear 102 in the chamber below lower latch cover 106. Planetary gear set 110 comprises an internal ring gear 112, a plurality of planet gears 114 that are rotably mounted on a planet carrier 116 and a sun gear 118 that is part of a compound gear 120. Planet carrier 116, sun gear 118 and compound gear 120 are removed in FIGS. 2 and 3 to show internal detail. The operation of a planetary gear set is well known and need not be described in detail.

Suffice it to say that sun gear 118 is the input and that planet carrier 116 is the output when ring gear 112 is held stationary. Planet carrier 116 has a plurality of depending pins 122 that protrude into arcuate slots 124 of cinch gear 102 to make a driving connection with a small lost motion for a purpose explained below. As indicated above, sun gear 118 is part of compound gear 120. Compound gear 120 includes a drive gear 126 that meshes with a compound transfer gear 128 that rotates on shaft 135 as shown in FIGS. 1 and 4. Transfer gear 128 has a large diameter upper gear 129 that is located above lower latch cover 106 and a small diameter lower gear 131 that protrudes through a hole into the chamber below to mesh with drive gear 126. Upper gear 129 is driven by a worm gear 130 that is driven by an electric motor 132. Electric motor 132 is mounted on lower latch cover 106 and covered by an upper latch cover 107 that also covers upper gear 129 and worm gear 130.

Cinch mechanism 100 further includes a one way device 133 comprising a plurality of pockets 134 in the outer surface of internal ring gear 112, and two pawls 136 and 138 that are pivotally mounted on studs 140 and 142 of latch housing 18, respectively. Pawls 136 and 138 are connected by a pawl link 144 so that pawls 136 and 138 move into pockets 134 and driving engagement with ring gear 112 or out of pockets 134 and out of driving engagement with ring gear 112 in unison. A return spring 146 (FIGS. 1 and 4) mounted in housing 18 engages pawl 138 and biases pawls 136 and 138 against the periphery of ring gear 112.

Cinch mechanism 100 operates as follows. When the vehicle door is shut tight enough so that fork bolt 28 is pivoted to the secondary latched position where detent lever 36 engages secondary latch shoulder 39 (not shown) or alternatively toward the primary latched position shown in FIG. 2 by a predetermined amount, a limit switch (not shown) is closed energizing electric motor 132 which drives sun gear 118 via worm gear 130, compound transfer gear 128 and compound gear 120. Ring gear 134 is held stationary against clockwise rotation by pawls 136 and 138 so that planet carrier 116 rotates counterclockwise. Planet carrier 116 in turn rotates cinch gear 102 counterclockwise. Cinch gear 102 in turn rotates fork bolt 28 clockwise to the primary latched position where a second limit switch (not shown) is closed to shut off electric motor 132.

Cinch mechanism 100 also allows manual closing and fully latching of the door. When the door latch 10 is closed manually, with sufficient force, fork bolt 28 is rotated clockwise to the primary latch position shown in FIG. 2. Fork bolt 28 in turn rotates cinch gear 102 and planet carrier 116 counterclockwise. Due to ramps at the counterclockwise ends of pockets 134. Pawls 136 and 138 allow counterclockwise rotation of ring gear 112 so that planet gears 114 do not drive sun gear 118. Consequently door latch 10 can be latched in the primary latched position manually without any need to back drive electric motor 132. This means that door latch 10 can be latched in the primary latched position with considerably less effort than that needed to also back drive electric motor 32. Moreover, the small lost motion between pins 122 and arcuate slots 124 accommodates over slam, that is, fork bolt 28 moving past the primary latched position shown in FIG. 2 and returning to primary latched position without back driving electric motor 132. Hence electric motor 132 never prevents the fork bolt 28 from returning to the primary latched position from an overslam.

Door latch 10 also includes a release mechanism 148 that allows forkbolt 28 to move to the unlatched position without back driving motor 132 whenever the door is opened. Release mechanism 148 comprises an unlatch link 150 that connects pawl 136 to transfer lever 52 by means of a perpendicular tab 152 of transfer lever 52 that engages in an oversize slot 154 at one end of the unlatch link 150. This is a lost motion connection, the purpose of which is explained below. The opposite end of unlatch link 150 is pivotally attached to pawl 136.

Release mechanism 148 operates as follows. When door latch 10 is unlatched to open the door as shown in FIG. 3, transfer lever 52 is pivoted counterclockwise from the primary latched position by either inside unlatching lever 54 or outside unlatching lever 56. Transfer lever 52 in turn pulls intermittent lever 44 and unlatch link 150 down as viewed in FIGS. 2, 3 and 4. Intermittent lever 44 pivots detent lever 38 to the disengaged position while unlatch link 150 simultaneously pivots pawls 136 and 138 clockwise out of pockets 134 and out of driving engagement with the periphery of internal ring gear 112. Fork bolt 28 is now free to rotate counterclockwise from the primary latched position shown in FIG. 2 to the unlatched position shown in FIG. 3 when the door is opened while ring gear 112 is free to rotate in either direction. When fork bolt 28 is rotated counterclockwise by the opening door, fork bolt 28 in turn rotates cinch gear 102 and planet carrier 122 clockwise. Planet gears 114 in turn rotate the freed internal ring gear 112 clockwise thus avoiding any necessity to back drive electric motor 132 via sun gear 118, drive gear 126, compound transfer gear 128 and worm gear 130 which would require substantially more effort.

As indicated above, when the door is closed manually, ring gear 112 rotates counterclockwise due to the ramps at the counterclockwise ends of pockets 134. The counterclockwise rotation of ring gear 112 in turn pivots pawls 131 and 138 counterclockwise which in turn lowers unlatch link 150. The lost motion connection provided by tab 152 in oversize slot 154 allows unlatch link 150 to move lower as viewed in FIG. 3 without disturbing transfer lever 52 during the manual closing of the fork bolt 28.

The sun gear 118 is the preferred input element of the planetary gear set 120 and the planet carrier 116 is the preferred output element when the planetary gear set 120 is driven by the electric motor 132. However, any of the three planetary gear set elements of sun gear, planet carrier, and ring gear can serve as input or output. In other words, although the preferred embodiments of the present invention have been discussed, various changes and modifications may be made by one skilled in the art without departing from the scope and spirit of the invention as set forth in the appended claims. It is also understood that the terms used herein are merely descriptive, rather than limiting, and that various changes may be made without departing from the scope and spirit of the invention.

What is claimed is:

1. A cinching door latch having a fork bolt that pivots between a primary latched position and an unlatched position; a detent lever that pivots between an engaged position and a disengaged position; the detent lever holding the fork bolt in the latched position when in the engaged position and releasing the fork bolt for movement to the unlatched position when in the disengaged position; a transfer lever that pivots between a latch position and an unlatch position, the transfer lever being operatively connected to the detent lever for pivoting the detent lever to the disengaged position; and a cinching mechanism for pivoting the fork bolt to the primary latched position characterized in that the cinching mechanism comprises:

a cinching gear drivingly connected to the fork bolt, a power driven planetary gear set for driving the cinching gear, and a one-way device for limiting rotation of an element of the planetary gear set to one direction so that the power driven planetary gear set can drive the cinching gear to drive the fork bolt to the primary latched position.

2. The cinching door latch of claim 1 characterized in that the cinching mechanism includes a release mechanism for disabling the one-way device so that the element of the gear set rotates in either direction.

3. A cinching door latch having a fork bolt that pivots between a primary latched position and an unlatched position; a detent lever that pivots between an engaged position and a disengaged position; the detent lever holding the fork bolt in the latched position when in the disengaged position and releasing the fork bolt for movement to the unlatched position when in the release position; a transfer lever that pivots between a latch position and an unlatch position, the transfer lever being operatively connected to the detent lever for pivoting the detent lever to the disengaged position; and a cinching mechanism for pivoting the fork bolt to the primary latched position characterized in that the cinching mechanism comprises, a cinching gear drivingly connected to the fork bolt, a planetary gear set having a sun gear, a ring gear and planet gears that are rotatably mounted on a planet carrier and that mesh with the sun gear and the ring gear;

the planet carrier being drivingly connected to the cinching gear, a motor for driving the sun gear, and a one-way device for limiting rotation of the ring gear to one direction so that the power driven planetary gear set can drive the cinching gear to drive the fork bolt to the primary latched position.

4. The cinching door latch of claim 3 characterized in that the cinching mechanism includes a release mechanism for disabling the one way device so that the ring gear rotates in either direction.

5. A cinching door latch having a fork bolt that pivots between a primary latched position and an unlatched position; a detent lever that pivots between an engaged position and a disengaged position; the detent lever holding the fork bolt in the latched position when in the disengaged position and releasing the fork bolt for movement to the unlatched position when in the release position; a transfer lever that pivots between a latch position and an unlatch position, the transfer lever being operatively connected to the detent lever for pivoting the detent lever to the disengaged position; and a cinching mechanism for pivoting the fork bolt to the primary latched position characterized in that the cinching mechanism comprises, a cinching gear drivingly connected to the fork bolt, a planetary gear set having a sun gear, a ring gear and planet gears that are rotatably mounted on a planet carrier and that mesh with the sun gear and the ring gear;

the planet carrier being drivingly connected to the cinching gear, a motor for driving the sun gear, a one-way device for limiting rotation of the ring gear to one direction so that the power driven planetary gear set can drive the cinching gear to drive the fork bolt to the primary latched position, the cinching mechanism including a release mechanism for disabling the one way device so that the ring gear rotates in either direction the release mechanism being operated by the transfer lever so that the release mechanism is disabled when the transfer lever is pivoted to the unlatch position to avoid back driving the motor.

6. A cinching door latch having a fork bolt that pivots between a primary latched position and an unlatched position; a detent lever that pivots between an engaged position and a disengaged position; the detent lever holding the fork bolt in the latched position when in the engaged position and releasing the fork bolt for movement to the unlatched position when in the disengaged position; a transfer lever that pivots between a latch position and an unlatch position, the transfer lever being operatively connected to the detent lever for pivoting the detent lever to the disengaged position; and a cinching mechanism for pivoting the fork bolt to the primary latched position characterized in that the cinching mechanism comprises;

a cinching gear meshing with teeth of the fork bolt, a planetary gear set having a sun gear, and internal ring gear and planet gears that are rotatably mounted on a planet carrier and that mesh with the sun gear and the internal ring gear, the planet carrier being concentric with and drivingly connected to the cinching gear, an electric motor drivingly connected to the sun gear via a gear train, a one-way device having a pivotally mounted pawl that drivingly engages an outer periphery of the internal ring gear to limit rotation of the internal ring gear to one direction so that the power driven planetary gear set can drive the cinching gear to drive the fork bolt to the primary latched position, and a release mechanism having an unlatch link that pivots the pawl out of driving engagement with the periphery of the internal ring gear to disable the one-way device so that the internal ring gear rotates in either direction, the unlatch link being operatively connected to the transfer lever so that the one-way device is disabled when the transfer lever is pivoted to the unlatch position to avoid back driving the electric motor.

7. The cinching door latch of claim 6 characterized in that the one-way device comprises a second pivotally mounted pawl that drivingly engages the periphery of the internal ring gear to limit rotation of the internal ring gear to the one direction and a pawl link that connects the second pivotally mounted pawl to the first pivotally mounted pawl so that the second pivotally mounted pawl moves out of driving engagement with the periphery of the internal ring gear when the first pivotally mounted pawl is moved away from the periphery of the internal ring gear by the unlatch link.

8. The cinching door latch of claim 6 characterized in that the planet carrier is drivingly connected to the cinching gear with a lost motion connection to accommodate over slam of the fork bolt responsive to a manual closing.

9. The cinching door latch of claim 6 characterized in that the unlatch link is operatively connected to the transfer lever with a lost motion connection so that the transfer lever is undisturbed responsive to a manual closing.

10. The cinching door latch of claim 9 characterized in that the unlatch link is pivotally mounted to the pawl at one end and operatively connected to the transfer lever at an opposite end by a tab of the transfer lever being disposed in an oversize slot of the unlatch link to provide the lost motion connection.

* * * * *